US005354408A

United States Patent [19]

Otomine et al.

[11] Patent Number: 5,354,408

[45] Date of Patent: Oct. 11, 1994

[54] FILM SPLICER

[75] Inventors: Yuzo Otomine, Kanagawa; Eiji Takamizawa; Wataru Narukawa, both of Saitama, all of Japan

[73] Assignees: Somar Corporation, Tokyo, Japan; Yugengaisha Tokyo Seiki Seisa kusho, Tokyo, Japan

[21] Appl. No.: 163,698

[22] Filed: Dec. 9, 1993

[30] Foreign Application Priority Data

Dec. 11, 1992 [JP] Japan ..... 4-353074

[51] Int. Cl.[5] ..... B65H 21/00; B31F 5/06

[52] U.S. Cl. ..... 156/505; 156/304.3; 156/507; 156/513; 156/517; 156/522

[58] Field of Search ..... 156/157, 304.1, 304.3, 156/505, 506, 507, 513, 517, 522, 530; 242/59

[56] References Cited

U.S. PATENT DOCUMENTS

| | | | |
|---|---|---|---|
| 2,475,351 | 4/1946 | Castoy | 156/507 X |
| 3,136,678 | 6/1964 | Harzig | 156/157 X |
| 3,428,511 | 2/1969 | Catozzo | 156/505 |
| 3,607,572 | 9/1971 | Jorgensen | 156/505 |
| 3,717,535 | 2/1973 | Jorgensen | 156/506 X |
| 4,002,522 | 1/1977 | Catozzo | 156/157 X |
| 5,123,992 | 6/1992 | Kanda et al. | 156/506 |

*Primary Examiner*—Mark A. Osele

*Attorney, Agent, or Firm*—Sughrue, Mion, Zinn, Macpeak & Seas

[57] ABSTRACT

To correctly splice two films to each other in the end-to-end relationship, a film splicer includes as essential components a base platform, a film guide mechanism arranged on the base platform, an arm member adapted to be turnably depressed against the upper surface of the film guide mechanism by actuating a handle for a cutter holder, an adhesive tape feeding mechanism, and a pair of tape cutters arranged on the lower surface of the arm member for cutting an adhesive tape in a film splicing operation region corresponding to the width of each film to be spliced. The adhesive tape feeding mechanism is composed of an adhesive tape unrolling member, a holding member for temporarily holding the foremost end part of the unrolled adhesive film, and an opposing pair of adhesive tape folding-back members for folding back the unrolled adhesive tape at a predetermined position in front of the film splicing operation region. A plurality of perforation punches are disposed on the lower surface of the arm member to form a plurality of perforations through films to be spliced to each other.

10 Claims, 6 Drawing Sheets

FILM SPLICER

BACKGROUND OF THE INVENTION

1. Field of the Invention

The present invention relates generally to a film splicer for splicing the foremost ends of two films, especially tape automatic bonding films (hereinafter referred to simply as TAB films to each other with the aid of an adhesive tape serving as bonding means. More particularly, the present invention relates to improvement of a tape splicer of the foregoing type which assures that each tape splicing operation can correctly be achieved not only at a high efficiency but also at a high accuracy.

2. Description of the Related Art

An information recording film splicer has been heretofore practically used for the purpose of cutting and splicing a picture film, an information tape or the like. Among a plurality of conventional film splicers, an information recording film splicer includes as essential components a base platform having a guide member and a roll mounted thereon and an arm member adapted to be turnably raised and lowered on the base platform with the base end of the arm member pivotally secured to the base platform, in order to assure that the foremost ends of information recording tapes are brought in contact with each other at a predetermined position with unnecessary parts of the information recording tapes preliminarily cut off from the latter, and moreover, an adhesive tape is adhesively secured to both the information recording tapes along the foremost cut ends of the latter, as disclosed in an official gazette of Japanese Patent Laid-Open Publication NO. 62-86592. As the adhesive tape is drawn from a roll of adhesive tape, it is located above the information recording tape, and thereafter, the arm member is turnably thrust against the upper surface of the base platform by actuating a handle with an operator's hand so as to allow the information recording tape on the guide member to be depressed by a depressing plate attached to the lower surface of the arm member. Subsequently, the adhesive tape is cut at a predetermined position by actuating adhesive tape cutters located at the fore and rear ends of the depressing plate, and thereafter, two information recording tapes cut in that way are spliced to each other using a thin adhesive tape interposed therebetween for the purpose of performing a so-called film editing operation.

In recent years, a tape automatic bonding technique (hereinafter referred to as a TAB technique) is widely employed in many industrial fields as a method of installing integrated circuits on a printed circuit board for producing electronic calculators, electronic watches or clocks, liquid crystal monitors, computers or the like. The TAB technique is typically exemplified by a method of sequentially forming a plurality of wiring patterns on a long film corresponding to integrated circuits and then bonding lead wires extending from the wiring patterns to the corresponding terminals of the integrated circuits. Before and after the integrated circuits are installed on the printed circuit board, a TAB film is visually inspected so that a part of the TAB film including wiring patterns each having incorrect wiring and incorrect bonding detected thereon is removed by actuating a cutter and the remaining acceptable part of the TAB film is spliced to the opponent one in the same manner as the information recording tape editing operation to provide a single long film. With the conventional film splicer constructed in the above-described manner, an adhesive tape is adhesively attached merely to one surface of each of two tapes along the contact line where the foremost ends of the two tapes come in contact with each other. Thus, there sometimes arises a malfunction that both the tapes are parted away from each other, i.e., away from the joint line therebetween depending on how a certain high intensity of pulling power is applied to the tapes.

In view of the foregoing malfunction, a proposal was made with respect to a method of allowing the contact part between two tapes to be clamped between two halves of a folded adhesive tape which in turn is adhesively secured to the two tapes, and thereafter, cutting off an extra part of the adhesive tape by actuating a cutter or the like wherein the foregoing method was practically employed in the past for splicing 16 mm picture films to each other. With the proposed method, a long film having a plurality of film segments sequentially spliced to each other exhibits a high strength because the adhesive tape is adhesively secured to both the surface of the tape. However, since the folded part of the adhesive tape is projected outside of the film on the one side of the latter, it is liable of becoming an obstacle in the course of each film handling operation. For this reason, practical employment of the proposed method is not acceptable when two TAB films are spliced to each other.

To solve the foregoing problem, it is thinkable that two conventional film splicer are employed for TAB films. In this case, a first film splicer serves to allow an adhesive tape to be adhesively secured to a joint part between two TAB films. Subsequently, the adhesive tape is cut away from the joint part, and thereafter, the TAB films are turned upside down so that the original lower surfaces of the same are oriented in the upward direction. Then, a second film splicer serves to allow another adhesive tape to be adhesively secured to the foregoing joint part in the same manner as the first film splicer. However, since it is practically difficult to turn the TAB tapes upside down while they are linearly delivered to both the film splicers, it is thinkable from the viewpoint of practical use that the TAB films are successively delivered to the first film splicer and the second film splicer while they are displaced along a S-shaped path. However, to prevent circuit components such as integrally circuits or the like installed on a printed circuit board from being damaged or injured, the TAB films should basically be bent only in one direction. For this reason, it is not acceptable that they are bidirectionally bent. In addition, when two adhesive tapes are separately adhesively secured to the TAB films with the aid of two film splicers and an extra part of each adhesive tape is then cut off, the outer cut ends of the upper and lower adhesive tapes are usually positionally offset from each other. Thus, a part of the adhesive surface of each adhesive tape appears on the outer surface of each TAB film. However, this is not acceptable.

To solve the foregoing problem, an applicant common to the present invention has proposed a film splicer as disclosed in an official gazette of Japanese Patent Laid-Open Publication NO. 4-5022. According to the prior invention, the film splicer includes a first splicer for bringing the foremost ends of films to be spliced to each other in contact with each other, adhesively securing an adhesive tape to the upper surfaces of the films along the contact line therebetween and then cutting the foremost end part of the adhesive tape and a second splicer for adhesively securing another adhesive tape to the lower surfaces of the films along the contact line therebetween and then cutting the foremost end part of the adhesive tape. The distance between two tape receiving portions for receiving an adhesive tape not only before a guide member of the first splicer but also after the guide member of the same and the distance between blades of two cutters for cutting the foremost end parts of the adhesive tapes are determined to be slightly smaller than a width of each film, while the distance between two tape receiving portions for receiving another adhesive tape not only before a guide member for the second splicer but also after the guide member of the same and the distance between blades of two cutters for cutting the foremost end parts of the adhesive tapes are determined to be approximately equalized to the width of each film.

However, since the film splicer proposed by the applicant as disclosed in the official gazette of Japanese Patent Laid-Open Publication NO. 4-5022 includes two splicers in the combined state, a wide space is required for installing the two splicers on the film splicer. This leads to the result that the film splicer should be improved in respect of reduction of the space required for installing the two splicers, and moreover, the film splicer should be improved in respect of a cost required for installing the film splicer.

In addition, since the adhesive tapes are adhesively secured not only to the upper surfaces of the two tapes but also to the lower surfaces of the same with the aid of the two splicers, an adhesive tape cutting operation should twice be performed for the adhesive tapes with the result that the film splicer should additionally be improved in respect of an operational efficiency.

When an adhesive tape is drawn in the second splicer while the adhesive surface of the same is oriented in the upward direction, there arises a necessity for taking care so as not to allow the adhesive tape to be erroneously adhesively secured to the film after completion of adhesive securing of another adhesive tape to one surface of the film.

SUMMARY OF THE INVENTION

The present invention has been made in consideration of the aforementioned background.

An object of the present invention is to provide a film splicer which assures that the foremost ends of two films are correctly brought in contact with each other not only at a high efficiency but also at a high accuracy.

Another object of the present invention is to provide a film splicer of the foregoing type which assures that the structure of the film splicer is substantially simplified to fabricate the film splicer at a reduced cost.

According to one aspect of the present invention, there is provided a film splicer which comprises a base platform having a cutter disposed on the one side thereof for cutting each film to be spliced; a film guiding mechanism arranged on the upper surface of the base platform; an arm member adapted to be turnably depressed against the film guide mechanism on the upper surface of the base platform by turnably actuating a handle for a cutter holder, the base end of the arm member being pivotally supported on the base platform; an adhesive tape feeding mechanism for feeding an adhesive tape by unrolling a roll of adhesive tape, the adhesive tape feeding mechanism being composed of an adhesive tape unrolling member for unrolling the adhesive tape from the rear position of a film splicing operation region of the film guiding mechanism, a holding member for temporarily holding the foremost end part of the unrolled adhesive film at a predetermined position forwardly spaced away from the film splicing operation region by a predetermined distance, and an opposing pair of adhesive tape folding-back members for folding back the unrolled adhesive tape at a predetermined position located directly in front of the film splicing operation region; and a pair of tape cutters arranged on the lower surface of the arm member for cutting the unrolled adhesive tape in the film splicing operation region corresponding to the width of each film to be spliced, the tape cutters being operatively connected to the cutter holder.

To form a plurality of perforations in the equally spaced relationship through films to be spliced to each other, a plurality of perforation punches of which number is equal to that of the perforations are disposed on the lower surface of the arm member within the range of a predetermined length inside of the adhesive tape cutters while projecting therefrom.

The adhesive tape folding-back members are composed of a pair of support members spaced away from each other in the leftward/rightward direction and a pair of adhesive tape receiving pins projected inside of the supporting members. To achieve each film splicing operation, the support members are displaced toward each other in the leftward/rightward direction.

In addition, the film splicer includes a shifting mechanism adapted to be actuated such that the position of each of the support members is shifted from an approach position where the unrolled adhesive tape is folded back to an isolated position where any adhesive tape folding operation is not performed, and vice versa.

According to other aspect of the present invention, there is provided a film splicer which comprises a base platform having a cutter disposed on the one side thereof for cutting each film to be spliced; a film guiding mechanism arranged on the upper surface of the base platform, the film guiding mechanism including a film splicing operation region and a pair of film guiding regions located on the opposite sides of the film splicing operation region and being composed of a stationary plate fixedly secured to the base platform in the film splicing operation region with a plurality of perforation punch holes formed through the stationary plate, a pair of movable plates each adapted to slidably move in a guide groove formed in the leftward/rightward direction in each film guiding region, and a plurality of film foremost end supporting members arranged on the lower surface of each of the movable plates in the film splicing operation region for raising up the foremost end part of each film to be spliced in the course of the slidable movement of the movable plates; an arm member adapted to be turnably depressed against the film guiding mechanism on the upper surface of the base platform by actuating a handle for a cutter holder, the base end of the arm member being pivotally supported on the base platform; a first shifting mechanism adapted to be actuated such that the position of each of the movable plates is shifted from a first position where the foremost end of each film to be spliced is positionally determined to a second position where each film splicing operation is performed, and vice versa; an adhesive tape feeding mechanism for feeding an adhesive tape by unrolling a roll of adhesive tape, the adhesive tape feeding mechanism being composed of an adhesive tape unrolling member for unrolling the adhesive tape from the rear position of the film splicing operation region of the film guiding mechanism, a holding member for temporarily holding the foremost end part of the unrolled adhesive tape at a predetermined position forwardly spaced away from the film splicing operation region by a predetermined distance, and an opposing pair of adhesive tape folding-back members for folding back the unrolled adhesive tape at a predetermined position located directly in front of the film splicing operation region; a pair of tape cutters arranged on the lower surface of the arm member for cutting the unrolled adhesive tape in the film splicing operation region corresponding to the width of each film to be spliced, the tape cutters being operatively connected to the cutter holder; and a plurality of perforation punches disposed inside of the tape cutters to form a plurality of perforations through films to be spliced to each other.

Each of the film foremost end supporting members is prepared in the form of a resilient metallic piece of which fore end part is bent to exhibit a substantially U-shaped bent contour. In practice, each resilient metallic piece is secured to the lower surface of each of the movable plates while extending in the leftward/rightward direction at the positions corresponding to cutout portions formed at four corners of the film splicing operation region in such a manner that during the slidable movement of the movable plates, the resilient metallic piece collide against a plurality of protuberances formed on the bottom surface of a guide groove or the opposite sidewalls of the guide groove. At this time, the foremost end part of the resilient metallic piece is projected above the upper surfaces of the movable plates to raise up the foremost end parts of films to be spliced to each other.

The adhesive tape folding-back members are composed of a pair of support members spaced away from each other in the leftward/rightward direction and a pair of adhesive tape receiving pins projected inside of the support members. When a film splicing operation is performed, the support members are displaced toward each other in the leftward/rightward direction.

In addition, the film splicer includes a second shifting mechanism adapted to be actuated such that the position of each of the support members is shifted from an approach position where the unrolled adhesive tape is folded back to an isolated position where any adhesive tape folding operation is not performed, and vice versa.

On the other hand, the first shifting mechanism is substantially composed of a pair of column-shaped members having the movable plates fixedly secured to the upper surfaces thereof, a pair of supports plates having the column-shaped members upright standing thereon and spaced away from each other while extending in a single common plane in the leftward/rightward direction, a cam member turnably interposed between both the support plates, a lever operatively connected to the cam member so as to allow the latter to be turned, and a coil spring resiliently bridged between the support plates.

It is desirable that the support members for the adhesive tape folding-back members are fixedly secured to the support plates.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate a few preferred embodiments thereof.

Figure 1:
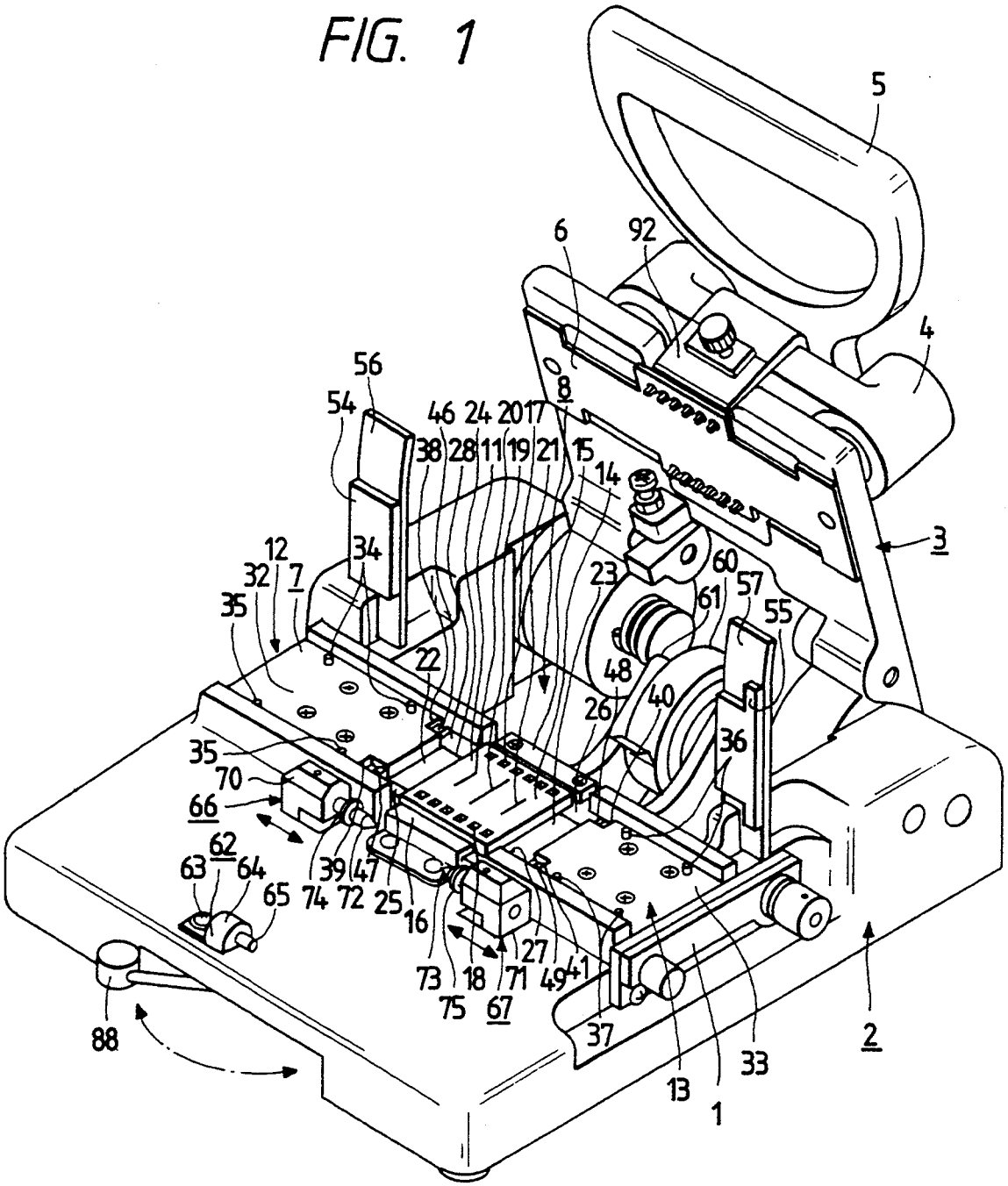
FIG. 1 is a perspective view of a film splicer constructed according to an embodiment of the present invention, particularly showing the whole structure of the film slicer.

FIG. 1 is a perspective view of a film splicer constructed according to an embodiment of the present invention, particularly showing the whole structure of the film splicer. The film splicer includes a base platform 2 on which a film cutter 1 is mounted on the right-hand side for cutting a film at a predetermined position of the latter. In addition, the film splicer includes an arm member 3 which is turnably mounted on the base platform 2. As the arm member 3 is turnably depressed with a handle 5 for a cutter holder 4 via biasing springs (not shown) to come in contact with the upper surface of the base platform 2, a retaining plate 6 secured to the lower surface of the arm member 3 is superimposed on a film guiding mechanism 7 for guiding the slidable displacement of films to be spliced to each other. An adhesive tape feeding mechanism 8 is arranged at the central part of the base platform 2 while it is located at the intermediate position of the film guiding mechanism 7.

Next, description will be made below with respect to the film guiding mechanism (hereinafter referred to simply as a guiding mechanism). The guiding mechanism 7 is composed of a film splicing operation region 11 and a pair of film guiding regions 12 and 13 arranged on the opposite sides of the film splicing operation region 11.

The film splicing operation region 11 is located at the substantially central part of the film guiding mechanism 7 as seen in the leftward/rightward direction (i.e., in the longitudinal direction of a film to be placed on the film splicing operation region 11), and includes a stationary plate 14 fixedly mounted on the base platform 2. In addition, a pair of tape receiving portions 15 and 16 each having the same height as that of the upper surface of the stationary plate 14 are disposed on the fore side and the rear side of the stationary plate 14 in the spaced relationship relative to the latter. The opposite fore corners of the tape receiving portion 16 are slightly rounded. The upper surface of the stationary plate 14 serves as a part of the film holding surface, and a width of the stationary plate 14 as seen in the longitudinal direction is dimensioned to be coincident with that of a part of each of films to be spliced to each other. A plurality of perforation die holes 17 and 18 are formed through the stationary plate 14 along the fore and rear edges of the latter. In addition, a center mark 19 is impressed at the film splicing position where the foremost ends of the films are spliced to each other, while set marks 20 and 21 are impressed at film end setting positions on the opposite sides of the center mark 19 in the spaced relationship as seen in the leftward/rightward direction. A distance between the center mark 19 and the set marks 20 and 21 is determined to be equal to a distance of the slidable displacement of each of movable plates 32 and 33. In the shown case, the foregoing distance is determined to be twice of the distance between adjacent perforation die holes 17 and 18. The distance between the opposite set marks 20 and 21 is determined to be slightly larger than the width of an adhesive tape 20.

Guide grooves 22 and 23 each having a substantially same width as that of each of films to be spliced to each other and having a uniform depth are formed in the film guiding regions 12 and 13 arranged adjacent to the film splicing region 11 on the opposite sides of the latter while extending in the leftward/rightward direction. In addition, two pairs of grooves 24, 25, 26 and 27 each having a small width are formed on the bottom of each of the guide grooves 22 and 23 along the fore and rear edges of the latter while extending in the leftward/-rightward direction. Protuberances 28, 29, 30 and 31 (only one protuberance 28 is visually recognized in the drawing) are projected above the grooves 24, 25, 26 and 27 at the center mark positions of the latter.

The movable plates 32 and 33 are arranged to slidably move in the leftward/rightward direction between a first position (i.e., a retracted position relative to the center mark 19) where the foremost ends of the films to be spliced to each other are positionally determined and a second position (i.e., a forward moved position relative to the center park 19) where the films are to be spliced to each other). Since the opposite side walls of the guide grooves 22 and 23 are machined and finished at a high accuracy, the positions of the movable plates 32 and 33 as seen in the longitudinal direction can be maintained at a very high accuracy irrespective of the slidable displacement of the movable plates 32 and 33 in the leftward/rightward direction. The upper surface of each of the movable plates 32 and 33 is located to assume the same height as that of the upper surface of the stationary plate 14 and serves as a part of the film holding surface. Perforation pins 34, 35, 36 and 37 are projected above the upper surfaces of the movable plates 32 and 33 along the fore and rear edges of the latter. A distance between adjacent perforation pins is determined to be equal to an even number of times of a distance between adjacent perforation holes.

Figure 2:
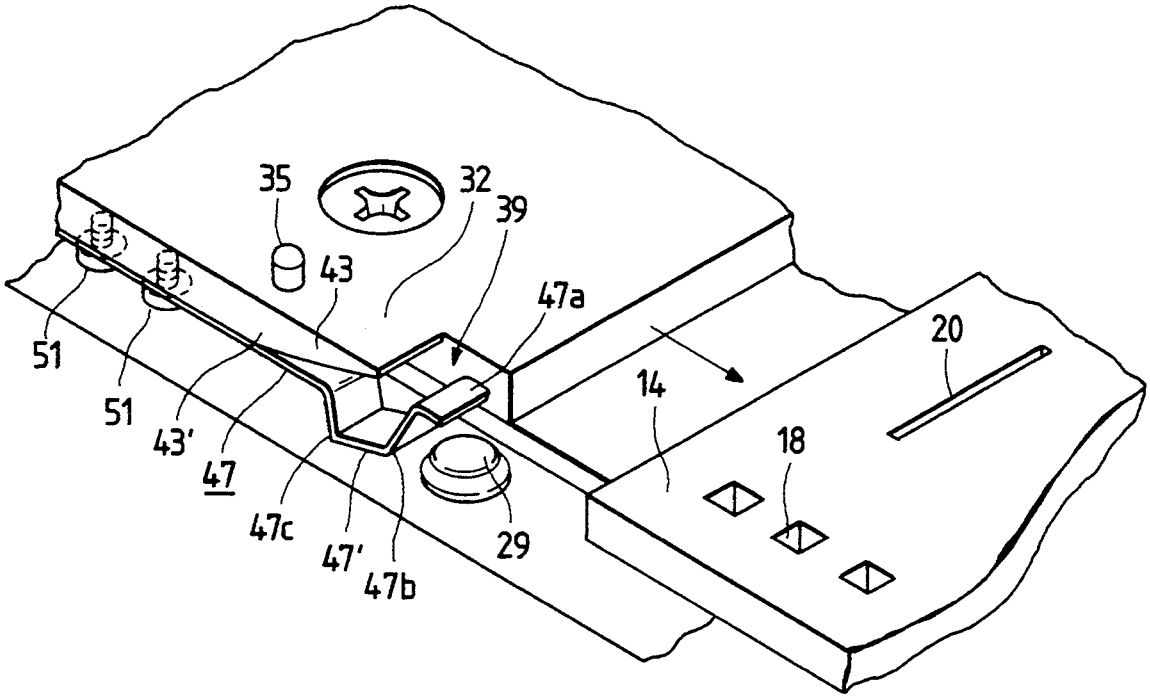
FIG. 2 is a fragmentary perspective view of the film splicer shown in FIG. 1, particularly showing the arrangement of movable plates and associated components.

Rectangular cutout portions 38, 39, 40 and 41 are recessed at the opposite corners of each of the movable plates 32 and 33 located on the stationary plate 14 side. As is apparent from FIG. 2, wedge-shaped portions 42, 43, 44 and 45 each having a smoothly curved surface extending toward the cutout portions 38, 39, 40 and 41 are formed on the movable plates 32 and 33 while they are located adjacent to the cutout portions 38, 39, 40 and 41 (in the shown case, only the cutout portion 39 and associated components are shown for the purpose of simplification and the associated components are designated by reference numerals other than those shown in FIG. 1). Resilient metallic pieces 46, 47, 48 and 49 are fixedly secured to base end parts 42', 43', 44' and 45' of the wedge-shaped portions 42, 43, 44 and 45 by tightening screws 50, 51, 52 and 53. For the purpose of simplification, description will typically be made hereinafter only with respect to the resilient metallic piece 47 with reference to FIG. 2. Specifically, the right-hand end of the resilient metallic piece 47 is deformed in the form of a substantially U-shaped bent part 47'. Specifically, the bent part 47' includes a film holding portion **47*a* adapted to come in contact with the lower surface of the fore end part of a film (not shown) on completion of the slidable movement of the movable plates 32 and 33 and bent parts 47*b* and 47*c* each adapted to successively collide against the protuberance 29 during the slidable movement of the movable plates 32 and 33. The resilient metallic piece 47 is secured to the base end part 43' of the wedge-shaped portion 43 on the movable plate 32 in the leftward/rightward direction as seen in FIG. 2 by tightening the screws 51, and the film holding portion 47*a* is received in the cutout portion 39 and assumes the position appreciably lower than the upper surface of the movable plate 32 (positional coincident with the film holding surface) when the movable plate 32** is located not only at a first position but also at a second position.

Film retaining arms 56 and 57 having rubber members 54 and 55 attached thereto are turnably arranged on the opposite sides of the guiding mechanism 7, and moreover, the film cutter 1 is arranged at the position located rightward of the right-hand end of the film retaining arm 57 in order to cut the film by actuating the film cutter 1.

Next, the adhesive tape feeding mechanism 8 will be described in more detail below. An adhesive tape holder 61 having a roll of adhesive tape 60 mounted thereon is disposed at the position located behind the film splicing operation region 11 of the guiding mechanism 7 so that the adhesive tape 60 is drawn from the adhesive tape holder 61 from the position slightly lower than the height of the film holding surface with an adhesive surface of the adhesive tape 60 orienting in the upward direction while the center of the adhesive tape 60 is substantially positionally coincident with the center mark 19.

A holding member 62 is disposed at the position located forward of the film splicing operation region 11 in the spaced relationship by a predetermined distance away from to the film splicing region 11 for temporarily holding the foremost end part of the unrolled adhesive tape 60. The holding member 62 is constructed such that a pin 65 is horizontally projected away from the right-hand surface of a support member 64 fixed secured to the base platform 2 by tightening a screw 63. The position of the pin 65 is located on an extension line extending from the center mark 19. An opposing pair of adhesive tape folding-back members 66 and 67 are arranged directly in front of the film splicing operation region 11 for folding back the unrolled adhesive tape 60 at a predetermined position of the latter in such a manner that they are slidably displaced in the leftward/rightward direction along slots (not shown) formed through the base platform 2. The adhesive tape folding members 66 and 67 are composed of support members 70 and 71 operatively connected to a shifting mechanism to be described later and tape receiving pins 72 and 73 horizontally projected from the opposite side surfaces of the support members 70 and 71. To positionally restrict the position of the unrolled adhesive tape 60 as seen in the direction of a width of the adhesive tape 60 at the time of folding-back of the adhesive tape 60, the tape holding pins 72 and 73 include flange-shaped restricting members 74 and 75. When the shifting mechanism is actuated, an approach position to be assumed by the adhesive tape folding-back members 66 and 67 for folding back the unrolled adhesive tape 60 (i.e., a forward position relative to the center of the adhesive tape 60) is shifted to an isolated position to be assumed by the same when the adhesive tape 60 is not folded back (i.e., a rearward position relative to the center of the adhesive tape 60), and vice versa. When the adhesive tape folding-back members 66 and 67 assume the approach position, the distance between a pair of restricting members 74 and 75 is determined to be approximately equalized to a width of the adhesive tape 60. It is preferable that the tape receiving pins 72 and 73 are molded of a material having poor adhesiveness to the adhesive tape 60, e.g., a polyacethal resin, a fluorine resin, a polypropylene resin, a polyethylene resin and a silicone resin.

A distance between the adhesive tape folding members 66 and 67 and the holding member 62 is determined to be approximately equalized to the distance between the adhesive tape folding-back members 66 and 67 and the rear end of the tape receiving portion 15 in order to assure that a film splicing operation can satisfactorily be achieved with a reduced loss of the adhesive tape 60 when the latter is folded back.

It should be noted that the tape receiving pins 72 and 73 are disposed at the positions slightly lower than the tape holding surface and the pin 62 of the holding member 62 is disposed at the position slightly lower than the height of the tape receiving pins 72 and 73.

Next, the shifting mechanism for shifting the positions of the movable plates 32 and 33 to another one will be described in more detail below.

Figure 3:
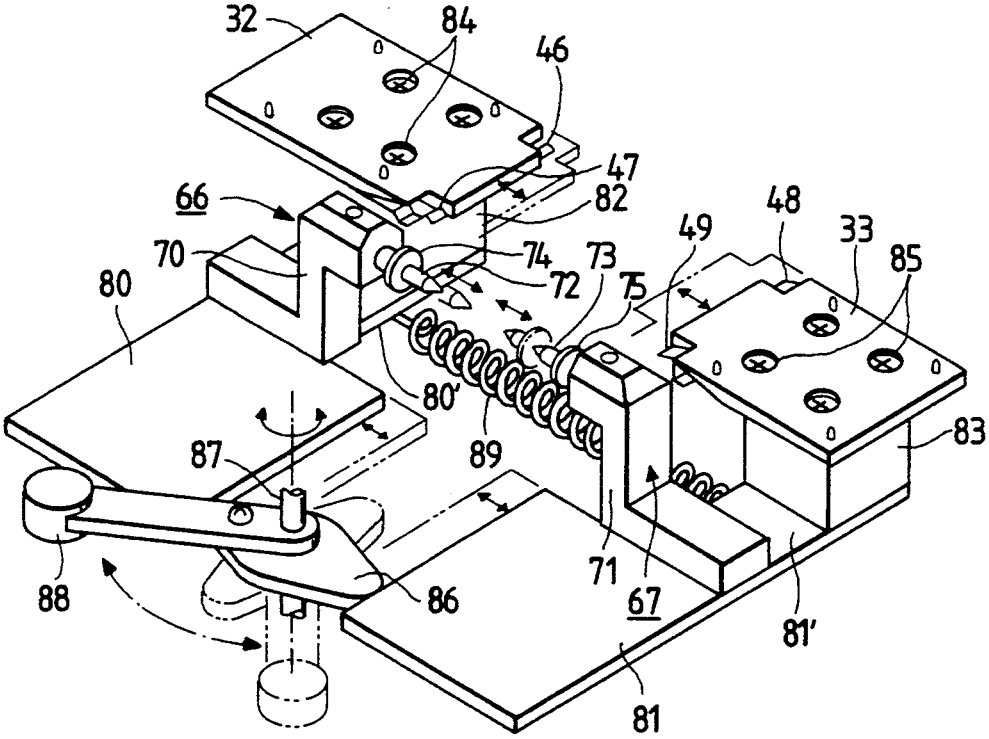
FIG. 3 is a fragmentary perspective view of the film splicer, particularly showing the structure of a shifting mechanism.

FIG. 3 shows by way of perspective view the structure of the shifting mechanism, and essential components constituting the shifting mechanism are accommodated in the hollow space of the base platform 2 located below the upper surface of the latter. Reference numerals 80 and 81 designate support plates, respectively. Support columns 82 and 83 each having a square cross-sectional contour symmetrically stand upright above the rear parts 80' and 81' of the support plates 80 and 81 each having a reduced width, and the movable plates 32 and 33 are fixedly secured to the upper surfaces of the support columns 82 and 83 by tightening screws 84 and 85. Substantially Z-shaped support members 70 and 71 of the adhesive tape folding members 66 and 67 are symmetrically arranged on the front side of the rear parts 80' and 81' of the support plates 80 and 81 in such a manner that the tape receiving pins 72 and 73 are located opposite to each other. Guide rails (not shown) extending in the leftward/rightward direction are secured to the rear surfaces of the support plates 80 and 81 so that they are operatively engaged with the opponent rail members (not shown) fixedly secured to the main platform 2 so as to enable the support plates 80 and 81 to be slidably displaced in the leftward/rightward direction. The support columns 82 and 83 for supporting the movable plates 32 and 33 thereon are located above the upper surface of the base platform 2 having slots (not shown) formed through the latter. The width of each of the slots as seen in the forward/rearward direction is approximately equalized to the width of each of the support columns 82 and 83. In addition, to assure that the positions of the support columns 82 and 83 as seen in the forward/rearward direction are exactly restricted, the width of each of the slots as measured in the leftward/rightward direction is determined to be sufficiently larger than the width of each of the support columns 82 and 83 as measured in the leftward/rightward direction in consideration of the quantity of displacement of the support columns 82 and 83. Similarly, the support members 70 and 71 for supporting the tape folding-back members 66 and 67 thereon are located above the upper surface of the base platform 2 having another slots (not shown) formed through the latter. These slots are formed on the base platform 2 for the support members 70 and 71 with a certain play not only in the forward/rearward direction but also in the leftward/rightward direction.

An elongated elliptical or rhombi cam member 86 is sandwiched between both the support plates 80 and 81 with a pivotal shaft 87 standing upright above the base platform 2 while vertically extending through the latter. When a lever 88 fixedly secured to the pivotal shaft 87 is turnably actuated with an operator' hand, the cam member 86 assumes the state as represented by solid lines (corresponding to the first position or the isolated position) or the state as represented by phantom lines (corresponding to the second position or the approach position).

The support plates 80 and 81 are normally biased toward the center mark 19 side by the resilient force of a coil spring 89 resiliently bridged between both the bottom portions of the rear parts 80' and 81' of the support plates 80 and 81.

Next, the arrangement of the arm member 3 and associated components will be described below.

Figure 4:
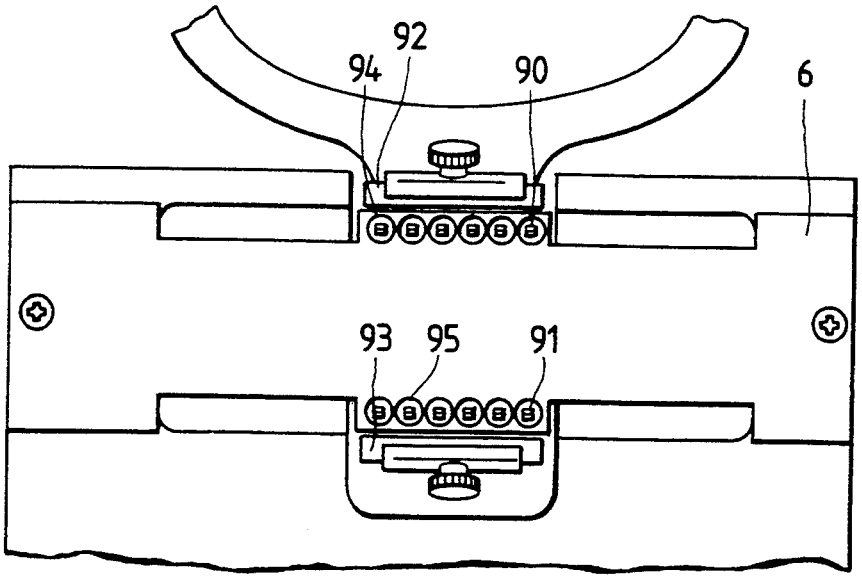
FIG. 4 is a fragmentary front view of the film splicer, particularly showing an arm member having a retaining plate attached thereto.
Figure 5:
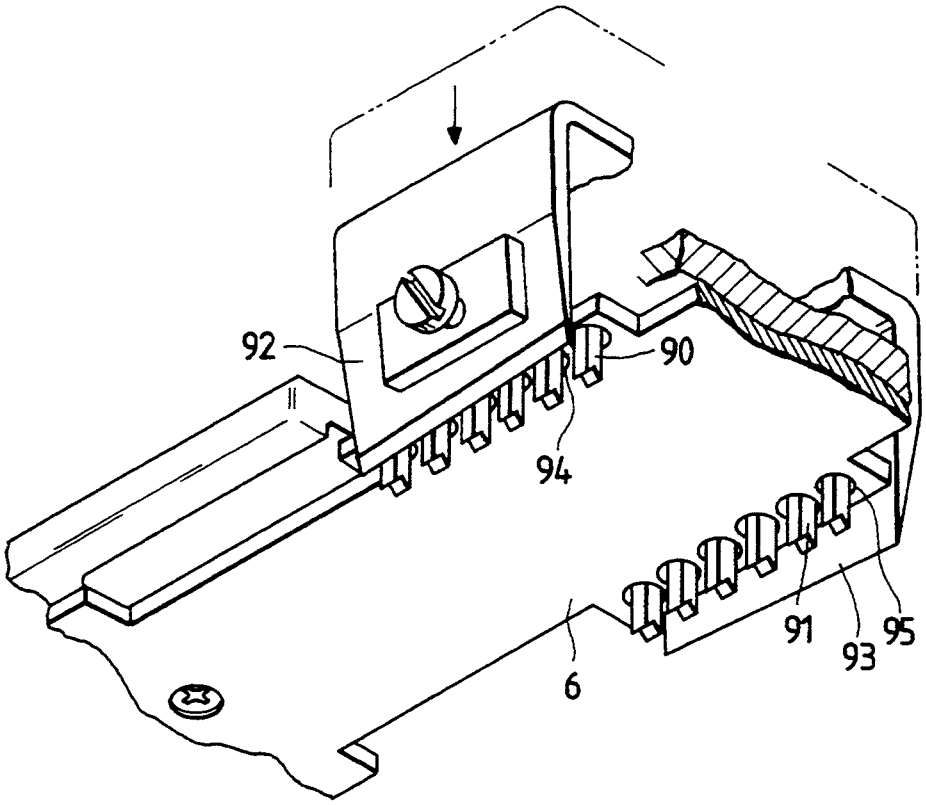
FIG. 5 is a fragmentary perspective view of the film splicer, particularly showing the arrangement of adhesive tape cutters, a plurality of perforation punches and associated components.

As shown in FIG. 1, FIG. 4 and FIG. 5, the retaining plate 6, two rows of perforation punches 90 and 91, and a pair of adhesive tape cutters 92 and 93 operatively associated with a cutter holder 4 are attached to the lower surface of the arm member 3 turnably supported on the base board 2. The adhesive tape cutters 92 and 93 are used to cut to assume a predetermined width of the adhesive tape 60 adhesively secured to the opposite surfaces of the spliced part of each of the films. Thus, the distance between blades of the taper cutters 92 and 93 is determined to be approximately equalized to the width of each of the films. It should be noted that the blades of the tape cutters 92 and 93 are inclined at a certain angle relative to the horizontal direction. In FIG. 5, reference numerals 94 and 95 designate punch holes, respectively. The punch holes 94 and 95 serve to allow the perforation punches 90 and 91 to be projected outside of the retaining plate 6 therethrough when the arm member 3 is turnably depressed with an operator's hand.

Next, a mode of operation of the film splicer constructed according to the embodiment of the present invention will be described in the following manner.

First, a series of steps of operating the film splicer will be described below.

(1) While the film splicer is maintained in the operative state shown in FIG. 1, a TAB film is fitted into the guiding mechanism 7 so that a plurality of perforations on the TAB film are engaged with the perforation pins 36 and 37 so as to allow the TAB film to be immovably held, the film is retained by the film retaining arm 57, and thereafter, the foremost end of an unnecessary part of the TAB film is cut off by actuating the film cutter 1.

(2) Next, the film is once disengaged from the guiding mechanism 7, and subsequently, it is placed on and engaged with the guiding mechanism 7 again while it is dislocated from the first position. Thereafter, the terminal end of the unnecessary part of the film is cut off by likewise actuating the film cutter 1.

(3) One of the preliminarily cut films is placed on the guiding mechanism 7 so that perforations of the film are engaged with the perforation pins 34 and 35. After the foremost end of the film is located to be coincident with the set mark 20 impressed on the stationary plate 14, the film is immovably held by turnably depressing the tape retaining arm 56. Next, perforations of the other film are engaged with the perforation pins 36 and 37, and thereafter, the foremost end of the other film is located to be coincident with the set mark 21 impressed on the stationary plate 14. Finally, the other film is likewise immovably held by turnably depressing the tape retaining arm 57.

Figure 6:
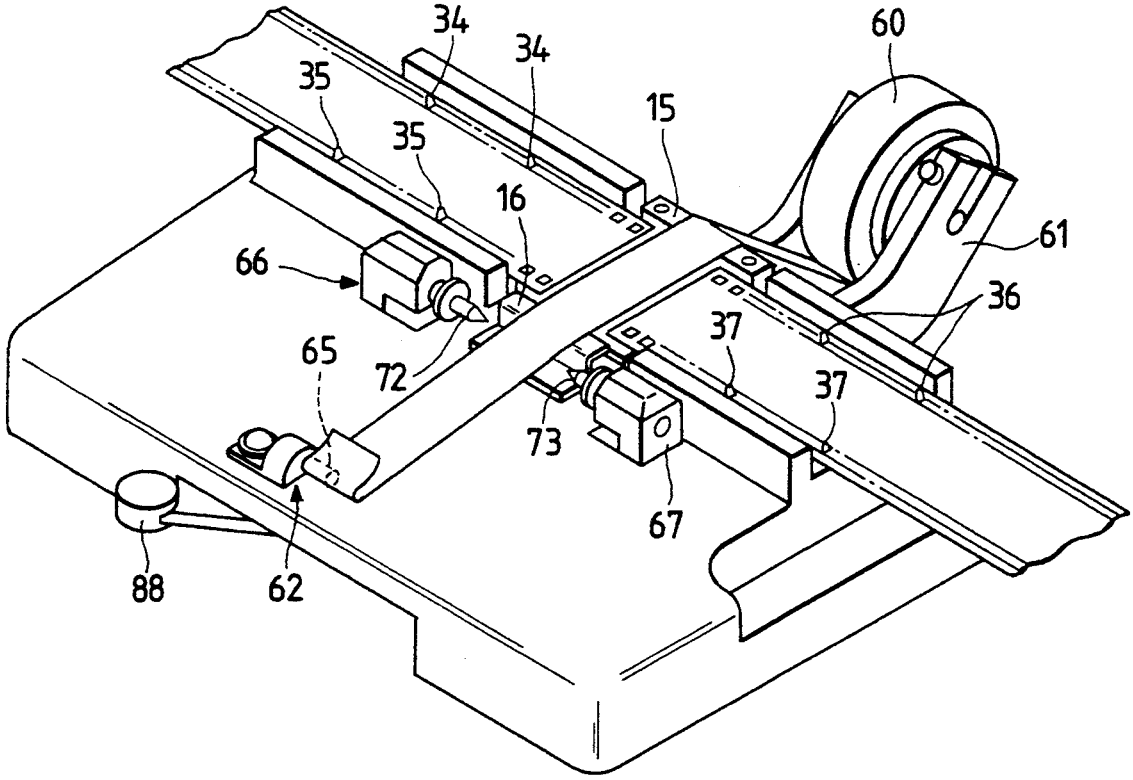
FIG. 6 is a fragmentary perspective view of the film splicer, particularly showing a mode of operation of the film splicer at a step of drawing an adhesive tape from a roll of adhesive tape for temporarily holding the foremost end part of the adhesive tape by a holding member.

(4) Next, the adhesive tape 60 is drawn from the adhesive tape holder 61 while an adhesive surface of the adhesive tape 60 is oriented in the upward direction. As shown in FIG. 6, on completion of the adhesive tape drawing operation, the foremost end part of the adhesive tape 60 is temporarily retained by the pin 65 of the holding member 62.

Figure 7:
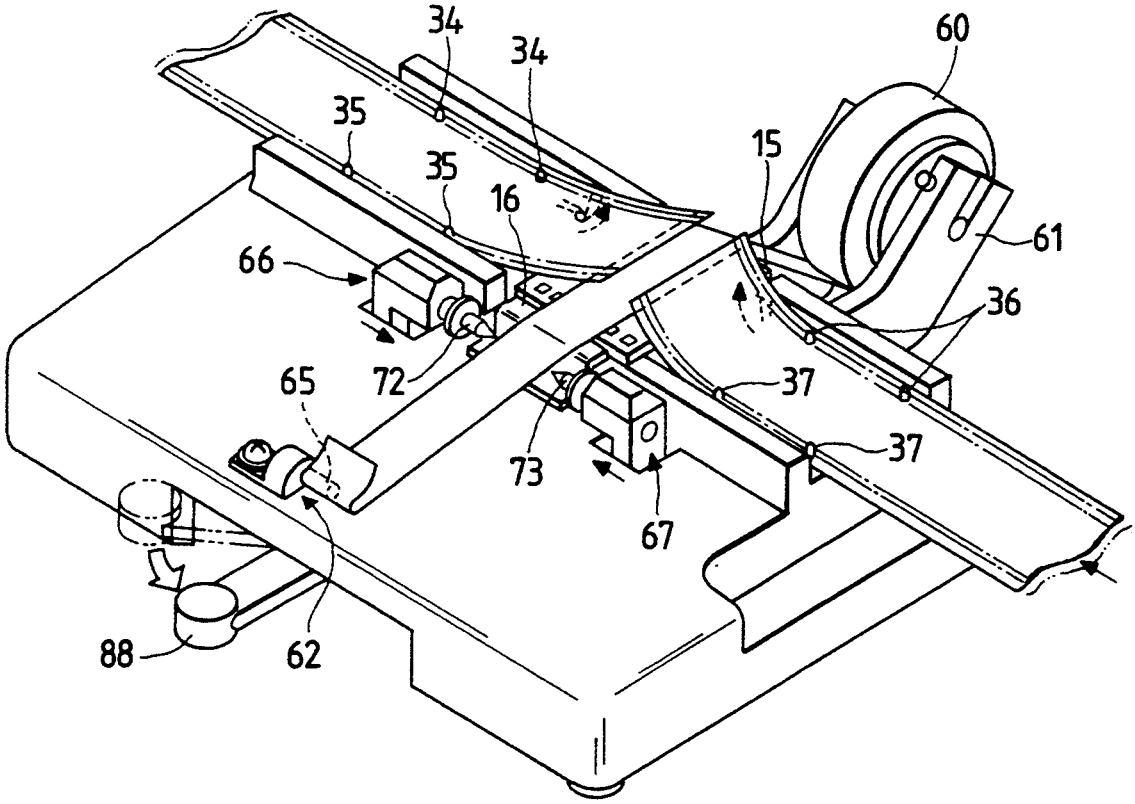
FIG. 7 is a fragmentary perspective view of the film splicer, particularly showing the foregoing mode of operation of the film splicer at a step of raising up the foremost end parts of films to be spliced to each other.

(5) While the foregoing state is maintained, the lever 88 is turned in the anticlockwise direction to assume its right-hand position. This causes the shifting mechanism to be actuated, whereby the movable plates 32 and 33 are slidably displaced toward the center mark 19 to move from the first position to the second position. At this time, the opposing pair of adhesive tape folding-back members 66 and 67 are displaced from the isolated positions to the approach positions (see FIG. 7). As the movable plates 32 and 33 are slidably displaced, the resilient metallic pieces 46, 47, 48 and 49 raise up the fore end parts; of both the films. When the movable plates 32 and 33 reach the second position, both the films come in contact with the adhesive surface of the adhesive tape 60 and then the foremost ends of the films abut against each other. Subsequently, the fore end parts of the films are thrusted against the adhesive surface of the adhesive film 60 with an operator's hand so that the rear surfaces of the films are adhesively connected to the adhesive surface of the adhesive film 60.

Figure 8:
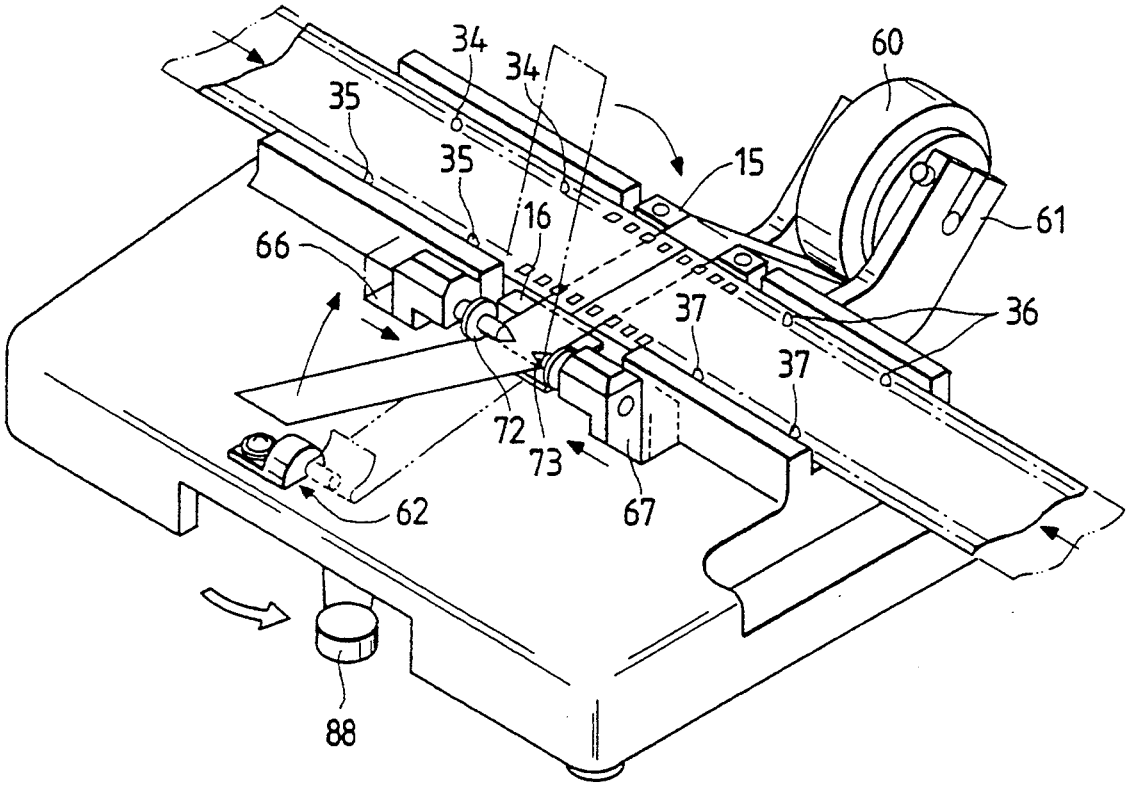
FIG. 8 is a fragmentary perspective view of the film splicer, particularly showing the foregoing mode of operation of the film splicer at a step of folding back the adhesive tape, FIG. 9(*a*), FIG. 9(*b*) and FIG. 9(*c*) are side views, respectively, showing the displacement of a resilient metallic piece.

(6) Next, as shown in FIG. 8, the foremost end part of the adhesive film 60 is disconnected from the pin 65 of the holding member 62, and thereafter, the adhesive tape 60 is folded back from the lower side of the tape receiving pins 72 and 73 of the tape folding members 66 and 67 so that the folded part of the adhesive tape 60 is brought in contact with the upper surfaces of the films and the foremost end of the folded part of the same is adhesively connected to the adhesive tape 60 on the tape receiving portion 15 side.

(7) While the foregoing state is maintained, the handle 5 is turnably depressed so that both the films are clamped between the retaining plate 6 and the guiding mechanism 7. Thereafter, the handle 5 is depressed further so as to allow the cutter holder 4 to be lowered against the resilient force of biasing springs (not shown) via bearing rollers (not shown) attached to the handle 5. Thus, as shown in FIG. 5, the blades of the adhesive tape cutters 92 and 93 and the perforation punches 90 and 91 are projected downward of the surface of the guiding mechanism 7 so that a plurality of perforations are formed through the films and the adhesive tapes 60, and moreover, the adhesive tapes 60 are cut to assume a width equal to that of each of the films. Thus, the film splicing operation carl be achieved by way of the aforementioned steps.

Next, a shifting operation to be performed by the shifting mechanism and a film raising operation to be performed by the resilient metallic pieces will be described below.

Figure 9A:
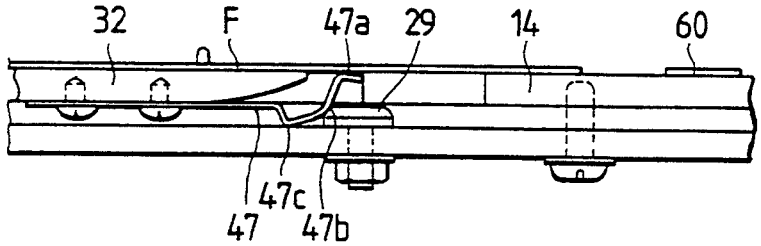
Figure 9B:
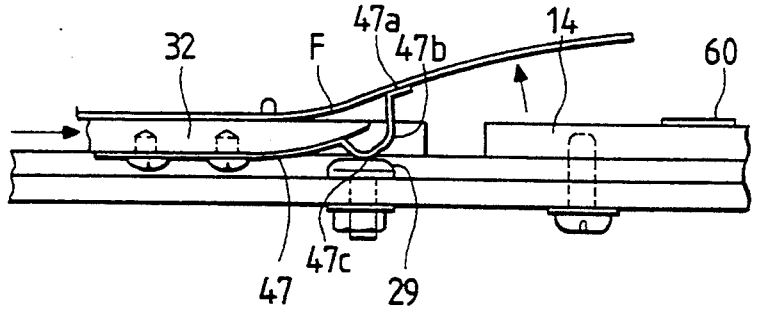
Figure 9C:
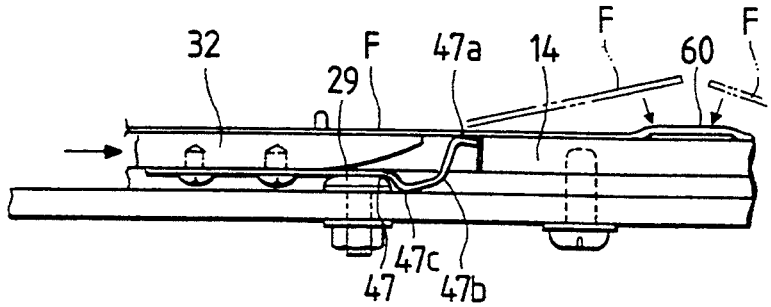

When an unnecessary part of each film is cut off and the foremost end part of the film is then held on the guiding mechanism 7, the lever 88 is located at the left-hand position, the movable plates 32 and 33 are located at the first position (i.e., at the retracted position), and the pair of tape folding members 66 and 67 are located at the isolated position (i.e., at the retracted position) as shown in FIG. 1 and FIG. 3. At this time, the long axis of the cam member 86 is oriented in the leftward/rightward direction and the support plates 80 and 81 are held at the positions as represented by solid lines in FIG. 3. Also, at this time, the resilient metallic pieces 46, 47, 48 and 49 secured to the lower surface of the movable plates 32 and 33 are held in the operative state as shown in FIG. 9(*a*). Specifically, the bent parts 46*b*, 47*b*, 48*b* and 49*b* and the bent parts 46*c*, 47*c*, 48*c* and 49*c* of the resilient metallic pieces 46, 47, 48 and 49 are not engaged with the protuberances 28, 29, 30 and 31, and the film receiving portions 46*a*, 47*a*, 48*a* and 49*a* are located slightly lower than the upper surfaces of the movable plates 32 and 33 (each serving as a film holding surface). In FIG. 9, reference character F designates a film.

When the lever 88 is turnably displaced from the left-hand position to the right-hand position for the purpose of film splicing, the cam member 86 is turned together with the pivotal shaft 87 until it assumes the position represented by phantom lines while the short axis of the cam member 86 is oriented in the leftward/-rightward direction. At this time, since the support plates 80 and 81 are inwardly biased by the resilient force of the coil spring 89, the shifting operation can smoothly be achieved without any possibility that the lever 88 is vibratively displaced in the course of the foregoing turning movement thereof. On completion of the shifting operation, the movable plates 32 and 33 are located at the second positions (i.e., at the forward positions), and the opposing pair of the tape folding members 66 and 67 are located at the approach positions (i.e., at the forward positions).

The behavior of the resilient metallic pieces 46, 47, 48 and 49 during the shifting operation will be described below.

After the bent parts 46*b*, 47*b*, 48*b* and 49*b* of the resilient metallic pieces 46, 47, 48 and 49 come in contact with the protuberances 28, 29, 30 and 31, the bent parts 46*c*, 47*c*, 48*c* and 49*c* of the same come in contact with the protuberances 28, 29, 30 and 31 as shown in FIG. 9(*b*), whereby the film receiving portions 46*a*, 47*a*, 48*a* and 49*a* of the resilient metallic pieces 46, 47, 48 and 49 are shifted from the slightly slantwise downward extending state to the slightly slantwise upward extending state, and moreover, the height of each of the resilient metallic pieces 46, 47, 48 and 49 is changed from the height lower than the upper surfaces (each serving as a film holding surface) of the movable plates 32 and 33 to the height higher than the same. This causes the film F to be raised up with the foremost end part thereof slightly slantwise upward extending, whereby there does not arise a malfunction that the foremost end part of the film F adheres to the adhesive surface of the adhesive tape 60 during the slidable movement of the movable plates 32 and 33. As the bent parts 46*c*, 47*c*, 48*c* and 49*c* of the resilient metallic pieces 46, 47, 48 and 49 climb over the protuberances 28, 29, 30 and 31, the film receiving portions 46*a*, 47*a*, 48*a* and 49*a* are gradually lowered until they assume the positions slightly lower than the upper surfaces of the movable plates 32 and 33. In this state, the foremost ends of films to be spliced to each other are permitted to abut against each other while they are located above the adhesive surface of the adhesive tape 60.

When the lever 88 is turnably displaced from the right-hand position to the left-hand position, operations reverse to those as mentioned above are performed so as to allow the movable plates 32 and 33 and associated components to be restored to the original positions shown in FIG. 3.

When the shifting mechanism performs a shifting operation as mentioned above, the approach positions of the opposing pair of tape folding members 66 and 67 are shifted to the isolated positions of the same as shown in FIG. 3. While the tape folding-back members 66 and 67 are located at the approach positions, since the distance between both the restricting members 74 and 75 is approximately equalized to the width of the adhesive tape 60, the adhesive tape 60 can easily be folded back. On the other hand, while they are located at the isolated positions, the adhesive tape 60 can smoothly be drawn to the holding member 62 without any hindrance arising during the drawing operation, and moreover, any waste material appearing on completion of each tape cutting operation can easily be removed from the film splicer.

As described above, with the film splicer constructed according to the embodiment of the present invention, the foremost end parts of two films can reliably be spliced to each other at a high efficiency via a single adhesive tape cutting operation.

Next, a film splicer constructed according to another embodiment of the present invention will be described below with reference to FIG. 10.

Figure 10:
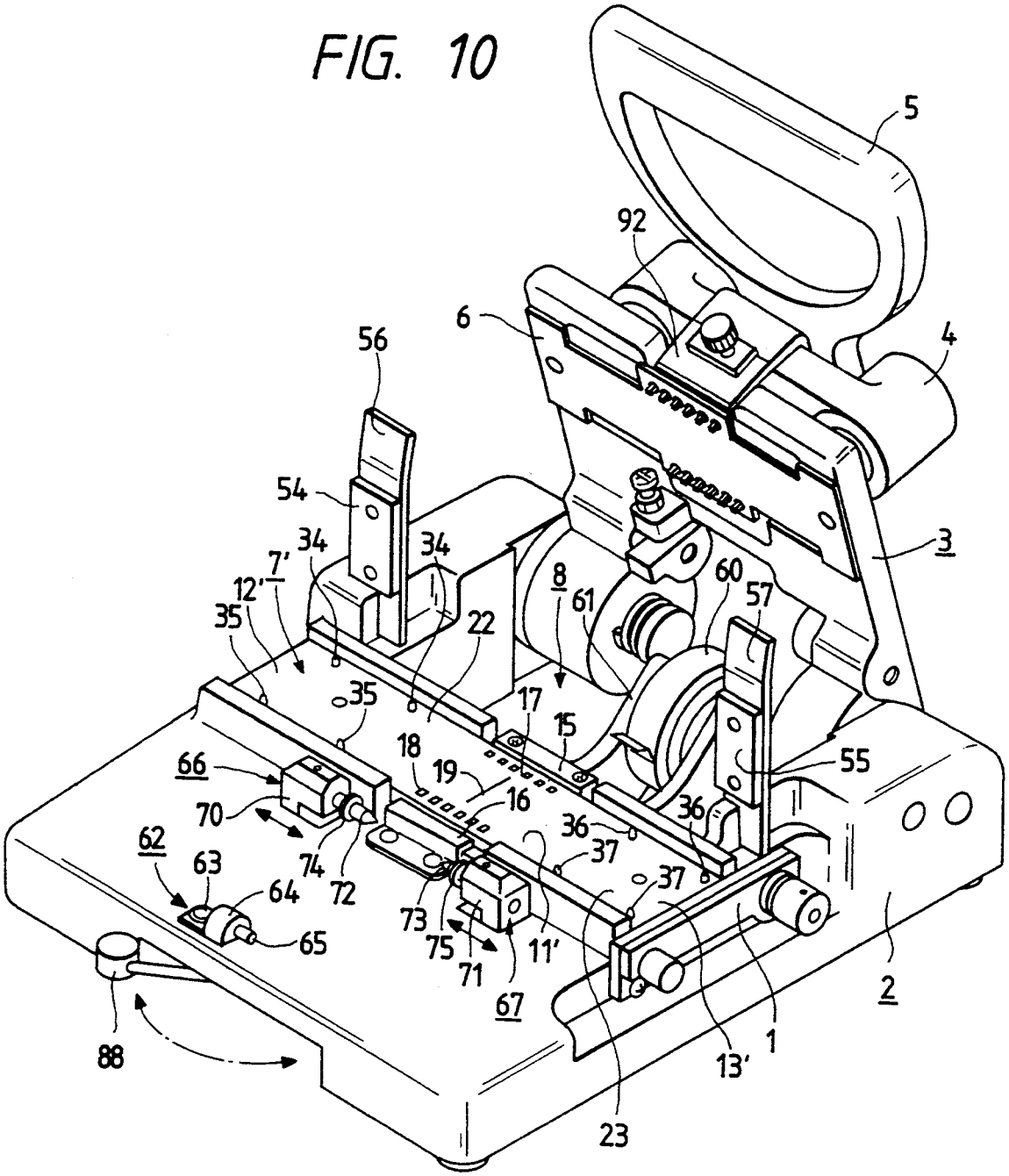
FIG. 10 is a perspective view of a film splicer constructed according to another embodiment of the present invention, particularly showing the whole structure of the film splicer.

FIG. 10 is a perspective view of the film splicer which shows the whole structure of the film splicer. Same components as those in FIG. 1 are designated by same reference numerals. In this embodiment, the structure of the film splicer is simplified much more than the film splicer shown in FIG. 1 and makes it possible to splice the foremost end parts of two films to be spliced to each other via a single depressing operation. Specifically, with the film splicer shown in FIG. 10, a stationary film guiding mechanism 7' is substituted for the film guiding mechanism shown in FIG. 1, and tape folding members are shifted from the isolated positions to the approach positions, and vice versa, by actuating the same shifting mechanism as mentioned above.

In this embodiment, the film guiding mechanism 7' is composed of a film splicing operation mechanism 11' and an opposing pair of film guiding regions 12' and 13'. The film holding surface of the film guiding region 12' is flush with the film holding surface of the film guiding region 13', and the film holding surfaces of both the film guiding regions 12' and 13' are kept stationary relative to the base board 2.

When the film splicer shown in FIG. 10 is practically employed, each film splicing operation is achieved by way of the following steps.

(1) An unnecessary part of each of two films to be spliced to each other is cut off in the same manner as the film splicer shown in FIG. 1.

(2) Subsequently, an adhesive tape 60 is drawn from an adhesive tape holder 61 while the adhesive surface of the adhesive tape 60 is oriented in the upward direction. At this time, the foremost end part of the adhesive tape 60 is temporarily held by a holding member 62.

(3) While the foregoing state is maintained, the fore end part of one film having an unnecessary part thereof cut off is fitted into the guiding mechanism 7', perforation pins 34 and 35 are fitted into perforations formed through the film, a part of the film on the guide mechanism end side is firmly retained by turnably depressing a tape retaining arm 56, and thereafter, while the foremost end of the film is positionally coincident with a center mark 19 in the film splicing operation region 11', the foremost end part of the film is thrusted against the adhesive surface of the adhesive film 60 so as to allow the lower surface of the film to come in contact with the adhesive tape 60. Similarly, the fore end part of the other film is fitted into the guiding mechanism 7', perforation pins 36 and 37 are fitted into perforations formed through the film, a part of the film on the guiding mechanism end side is firmly retained by turnably depressing a tape retaining arm 57, and thereafter, while the foremost end of the film is positionally coincident with the center mark 19, the foremost end part of the film is thrusted against the adhesive surface of the adhesive film 60 so as to allow the lower surface of the film to come in contact with the adhesive tape 60.

(4) While the foregoing state is maintained, a lever 88 is turned in the anticlockwise direction to assume the right-hand position. This causes the shifting mechanism to be actuated, whereby a pair of tape folding members 66 and 67 are displaced from the isolated positions (i.e., the retracted position) to the approach position (i.e., the forward position).

(5) Next, the foremost end part of the adhesive tape 60 is disconnected from a pin 65 of the holding member 62, the adhesive tape 60 is folded back from the lower side of tape receiving pins 72 and 73 of the tape folding members 66 and 67, both the tapes are spliced to each other with the aid of the folded part of the adhesive tape 60, and subsequently, the foremost end part of the folded adhesive tape 60 adheres to the adhesive tape 60 on the tape receiving portion 15 side.

(6) A handle 5 is turnably depressed in the same manner as the film splicer shown in FIG. 1 so that a plurality of perforations are formed through both the film, and moreover, the adhesive tape 60 is cut to assume the width of each of the films. Thus, each film splicing operation can be achieved by way of the aforementioned steps.

In the case that the film splicer is constructed as shown in FIG. 10, the foremost ends of two films can be spliced to each other with a simpler structure merely by single turnable actuation of the handle 5, provided that a care is taken such that the foremost end of each film is not adhesively connected to the adhesive tape 60 at a different position other than a predetermined one.

Although the present invention has been described above with respect to two preferred embodiments thereof, it should of course be understood that the present invention should not be limited only to these embodiments but various change or modification may be made without any departure from the scope of the present invention as defined by the appended claims.

In the aforementioned embodiments, it is assumed that the film splicer as shown in FIG. 1 and FIG. 10 is designed for the purpose of cutting a film having a width of 35 mm. However, the present invention should not be limited only to this width but the film splicer of the present invention may be employed for a film having an arbitrary width. For example, in the case that the film splicer is employed for a film having a very wide width of 158 mm, it is recommendable that two cutter holders of which lower ends are operatively connected to adhesive film cutters are arranged on the arm member 3 side, a handle of which base end is turnably supported on the upper surface of the arm member 3 is designed to have a width corresponding to the width of the film, and two parts of the handle are turnably supported by cutter holders.

In the embodiment shown in FIG. 1, a combination made among the cutout portions 38, 39, 40 and 41, the protuberances 28, 29, 30 and 31 and the resilient metallic pieces 46 is arranged at two locations in the film guiding regions 12 and 13 not only on the fore side of the latter but also on the rear side of the same. In the case that each of two films to be spliced to each other has a small width, the foregoing combination may be arranged at a single location in the central part of each film guiding region. On the contrary, in the case that each of the two films to be spliced to each other has a large width, the foregoing combination may be arranged at three or more locations in each guiding region.

In addition, in the embodiment shown in FIG. 1, the protuberances 28, 29, 30 and 31 are disposed on the recessed grooves 24, 25, 26 and 27 formed on the bottom surfaces of the guide grooves 22 and 23. Alternatively, they may be disposed directly on the bottom surfaces of the guide grooves 22 and 23. In this case, it is recommendable that each of the movable plates 32 and 33 has a slightly large thickness and the fore and rear ends of the movable plates 32 and 33 on the stationary plate 14 side are cut out so that the resilient metallic pieces 46, 47, 48 and 49 abut against the protuberances 46, 47, 48 and 49 in the cutout portions. Alternatively, the protuberances 28, 29, 30 and 31 may be disposed on the side wall portions of the guide grooves 22 and 23. In this case, it is obvious that they are not disposed on the guide grooves 22 and 23 or on the recessed grooves 24, 25, 26 and 27 formed on the bottom surfaces of the guide grooves 22 and 23.

The contour of each of the resilient metallic pieces 46, 47, 48 and 49 and the contour of each of the protuberances 28, 29, 30 and 31 may arbitrarily be made, provided that it is assured that the foremost end parts of the films are raised up during the slidable movement of the movable plates 32 and 33.

As is apparent from the above description, according to the present invention, since the film splicer is constructed in the above-described manner, each film splicing operation can correctly be achieved not only at a high efficiency but also at a high accuracy.

What is claimed is:

1. A film splicer comprising;

a base platform having a cutter disposed on the one side thereof for cutting each film to be spliced, a film guiding mechanism arranged on the upper surface of said base platform, an arm member adapted to be turnably depressed against said film guiding mechanism on the upper surface of said base platform by turnably actuating a handle for a cutter holder, the base end of said arm member being pivotally supported on said base platform, an adhesive tape feeding mechanism for feeding an adhesive tape by unrolling a roll of adhesive tape, said adhesive tape feeding mechanism being composed of an adhesive tape unrolling member for unrolling said adhesive film from the rear position of a film splicing operation region of said film guiding mechanism, a holding member for temporarily holding the foremost end part of the unrolled adhesive film at a predetermined position forwardly spaced away from said film splicing operation region by a predetermined distance, and an opposing pair of adhesive tape folding-back members for folding back the unrolled adhesive tape at a predetermined position located directly in front of said film splicing operation region, and a pair of tape cutters arranged on the lower surface of said arm member for cutting the unrolled adhesive tape in said film splicing operation region corresponding to the width of each film to be spliced, said tape cutters being operatively connected to said cutter holder.

2. The film splicer according to claim 1, wherein a plurality of perforation punches are disposed on the lower surface of said arm member within the range of a predetermined length inside of said adhesive tape cutters to form a plurality of perforations through films to be spliced to each other.

3. The film splicer according to claim 1, wherein said adhesive tape folding-back members are composed of a pair of support members spaced away from each other in the leftward rightward direction and a pair of adhesive tape receiving pins projected inside of said supporting members, said support members being displaced toward each other in the leftward/ rightward direction.

4. The film splicer according to claim 1 further including a shifting mechanism adapted to be actuated such that the position of each of said support members is shifted from an approach position where the unrolled adhesive tape is folded back to an isolated position where any adhesive tape folding operation is not performed, and vice versa.

5. A film splicer comprising;

a base platform having a cutter disposed on the one side thereof for cutting each film to be spliced, a film guiding mechanism arranged on the upper surface of said base platform, said film guiding mechanism including a film splicing operation region and a pair of film guiding regions located on the opposite sides of said film splicing operation region and being composed of a stationary plate fixedly secured to said base platform in said film splicing operation region with a plurality of perforation pin holes formed through said stationary plate, a pair of movable plates each adapted to slidably move in a guide groove formed in each film guiding region in the leftward/rightward direction, and a plurality of film foremost end supporting members arranged on the lower surface of each of said movable plates in said film splicing operation region for raising up the foremost end part of each film to be spliced in the course of the slidable movement of said movable plates, an arm men, her adapted to be turnably depressed against said film guiding mechanism on the upper surface of said base platform by actuating a handle for a cutter holder, the base end of said arm member being pivotally supported on said base platform, a first shifting mechanism adapted to be actuated such that the position of each of said movable plates is shifted from a first position where the foremost end of each film to be spliced is positionally determined to a second position where each film splicing operation is performed, and vice versa, an adhesive tape feeding mechanism for feeding an adhesive tape by unrolling a roll of adhesive tape, said adhesive tape feeding mechanism being composed of an adhesive tape unrolling member for unrolling said adhesive tape from the rear position of said film splicing operation region of said film guiding mechanism, a holding member for temporarily holding the foremost end part of the unrolled adhesive tape at a predetermined position forwardly spaced away from said film splicing operation region by a predetermined distance, and an opposing pair of adhesive tape folding-back members for folding back the unrolled adhesive tape at a predetermined position located directly in front of said film splicing operation region, a pair of tape cutters arranged on the lower surface of said arm member for cutting the unrolled adhesive tape in said film splicing operation region corresponding to the width of each film to be spliced, said tape cutters being operatively connected to said cutter holder, and a plurality of perforation punches disposed inside of said tape cutters to form a plurality of perforations through films to be spliced to each other.

6. The film splicer according to claim 5, wherein each of said film foremost end supporting members comprises a resilient metallic piece of which fore end part is bent to exhibit a substantially U-shaped bent contour, said resilient metallic pieces being secured to the lower surface of each of said movable plates while extending in the leftward/rightward direction at the positions corresponding to cutout portions formed at four corners of said film splicing operation region in such a manner that during the slidable movement of said movable plates, said resilient metallic pieces collide against a plurality of protuberances formed on the bottom surface of a guide groove or on the opposite side walls of said guide groove and the foremost end parts of said resilient metallic pieces are projected above the upper surfaces of said movable plates to raise up the foremost end parts of two films to be spliced to each other.

7. The film splicer according to claim 5, wherein said adhesive tape folding-back members are composed of a pair of support members spaced away from each other in the leftward rightward direction and a pair of adhesive tape receiving pins projected inside of said support members, said support members being displaced toward each other in the leftward rightward direction when the foremost ends of two films are spliced to each other.

8. The film splicer according to claim 5 further including a second shifting mechanism adapted to be actuated such that the position of each of said support members is shifted from an approach position where the unrolled adhesive tape is folded back to an isolated position where any adhesive tape folding operation is not performed, and vice versa.

9. The film splicer according to claim 5, wherein said first shifting mechanism is composed of a pair of column-shaped members having said movable plates fixedly secured to the upper surfaces thereof, a pair of support plates having said column-shaped members upright standing thereon and spaced away from each other while extending in a single common plane in the leftward/rightward direction, a cam member turnably interposed between said support plates, a lever operatively connected to said cam member so as to allow the latter to be turned, and spring means resiliently bridged between said support plates.

10. The film splicer according to claim 9, wherein said support members for said adhesive tape folding-back members are fixedly secured to said support plates.

* * * * *